US010594086B2

(12) United States Patent
Droesbeke et al.

(10) Patent No.: US 10,594,086 B2
(45) Date of Patent: Mar. 17, 2020

(54) ELECTRICAL SHIELDING MEMBER FOR A NETWORK CONNECTOR

(71) Applicant: Aptiv Technologies Limited, St. Michael (BB)

(72) Inventors: Gert Droesbeke, Erkrath (DE); Martin Ludwig, Wuppertal (DE); Andreas Kurpiela, Cologne (DE); Srinivasan Manoharan, Chennai (IN)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/258,729

(22) Filed: Jan. 28, 2019

(65) Prior Publication Data

US 2019/0260166 A1 Aug. 22, 2019

(30) Foreign Application Priority Data

Feb. 16, 2018 (EP) ..... 18157249

(51) Int. Cl.

| | |
|---|---|
| ***H01R 13/6582*** | (2011.01) |
| ***H01R 13/502*** | (2006.01) |
| ***H01R 13/6592*** | (2011.01) |
| ***H01R 43/20*** | (2006.01) |
| ***H01R 13/6583*** | (2011.01) |
| *H01R 9/03* | (2006.01) |
| *H01R 13/506* | (2006.01) |

(52) U.S. Cl.

CPC ..... *H01R 13/6582* (2013.01); *H01R 13/502* (2013.01); *H01R 13/6583* (2013.01); *H01R 13/6592* (2013.01); *H01R 43/20* (2013.01); *H01R 9/032* (2013.01); *H01R 13/506* (2013.01); *H01R 2201/04* (2013.01); *H01R 2201/26* (2013.01)

(58) Field of Classification Search

CPC ..... H01R 13/6582; H01R 13/502; H01R 13/6592; H01R 43/20

See application file for complete search history.

(56) References Cited

U.S. PATENT DOCUMENTS 6,033,260 A * 3/2000 Murata ..... H01R 13/6275 439/578
2019/0260166 A1* 8/2019 Droesbeke ..... H01R 13/502

FOREIGN PATENT DOCUMENTS

EP 2579396 A1 4/2013
EP 3107155 A1 12/2016

OTHER PUBLICATIONS

European Search Report for Application No. 18157249, European Patent Office, Jul. 26, 2018.

* cited by examiner

*Primary Examiner* — Abdullah A Riyami
*Assistant Examiner* — Nader J Alhawamdeh
(74) *Attorney, Agent, or Firm* — Robert J. Myers

(57) ABSTRACT

An electrical shielding member for a network connector includes a receiving portion for receiving a cable end of a shielded cable and a contact beam extending from the receiving portion. The contact beam has a first contact point for electrically connecting the electrical shielding member to a counter shielding member of a counter network connector, and a coupling portion, provided at a distal end of the contact beam. The coupling portion is configured to be coupled to a corresponding coupling portion of a network connector housing. The network connector is configured for network communication at data rates of at least 100 megabits per second (Mbit/s) and preferably at least 1 gigabits per second (Gbit/s).

16 Claims, 5 Drawing Sheets

ELECTRICAL SHIELDING MEMBER FOR A NETWORK CONNECTOR

CROSS-REFERENCE TO RELATED APPLICATION

This application claims the benefit under 35 U.S.C. § 119(a) of patent application Ser. No. 18/157,249.6 filed in the European Patent Office on Feb. 16, 2018, the entire disclosure of which is hereby incorporated by reference.

TECHNICAL FIELD OF THE INVENTION

The invention relates to an electrical shielding member for a network connector, a network connector system, as well as to a method to assemble the network connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
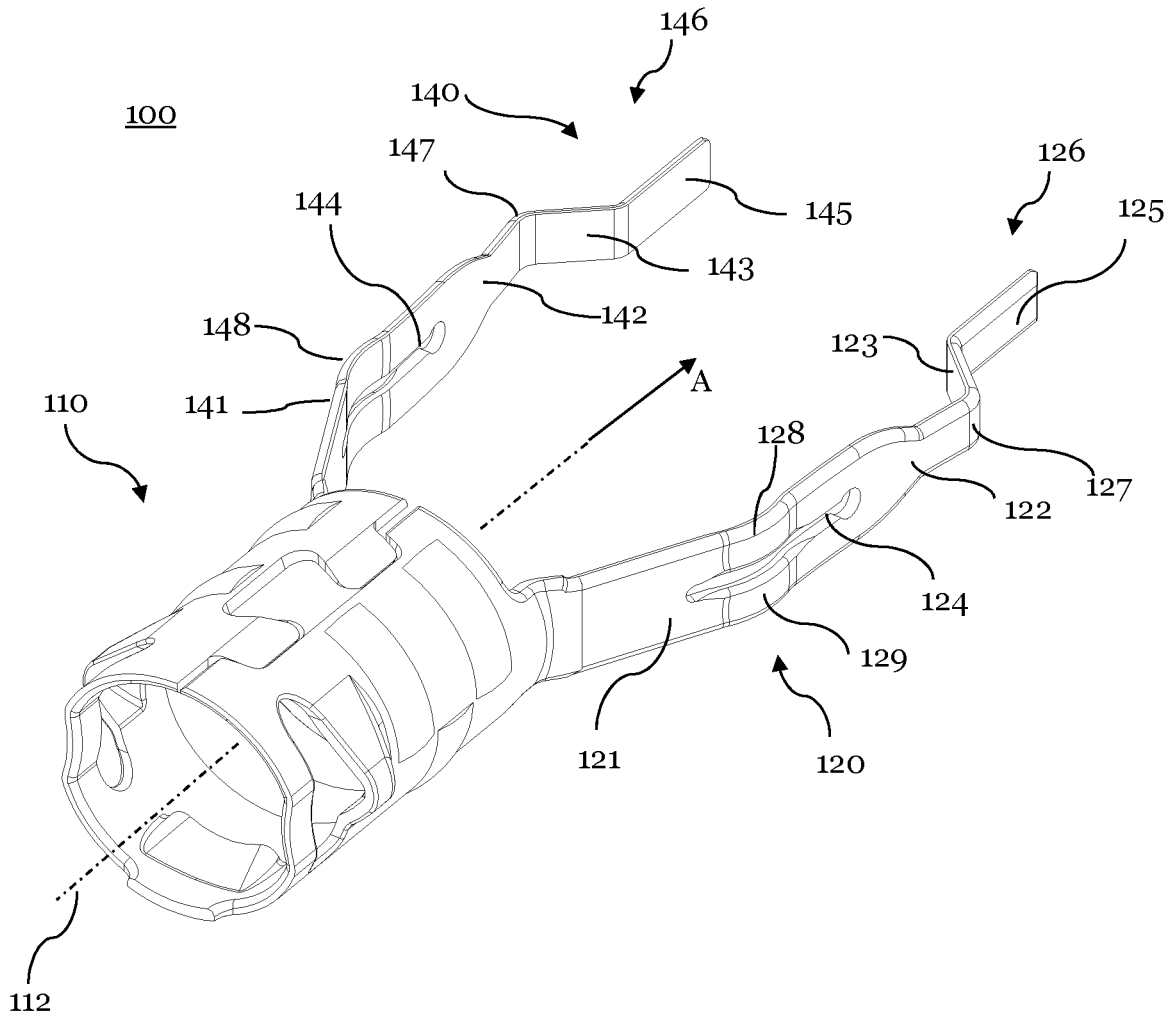
FIG. 1 is a perspective view of an electrical shielding member according to an embodiment of the invention.

Network connectors that are capable of network communication at data rates of at least 100 megabits per second (Mbit/s) and preferably at least 1 gigabits per second (Gbit/s) may be used in automotive applications, such as autonomous vehicles. In recent years, vehicles have been equipped with numerous on-board electronics. These on-board electronics provide a wide field of functionality, such as sensors, control functions and the like. These on-board electronics provide typical consumer electronic functions, navigation control and/or safety features, as well as e.g. feedback control for autonomous driving. Data networks have been established within vehicles for data communication between single on-board electronic components. These data networks communicate at high data rates to allow for a safe and reliable communication. Typically, data networks are based on Ethernet networks operating at data rates of 100 Mbit/s to 1 Gbit/s or more.

The need for higher data rates increases when providing new kinds of on-board electronics. However, higher data rates increase the cross-talk level between individual branches of the network, particularly if connectors and/or cables of these branches are arranged adjacent and substantially parallel to each other. This is typically the case in a vehicle wiring harness.

Further, the electromagnetic compatibility (EMC) properties of connectors decreases with increased data rates. Thus, different connectors are provided for 100 Mbit/s networks and 1 Gbit/s networks. Shielding members are typically provided in a housing of a network connector or the network connector system to prevent radiation from entering and/or leaving the connector housing to overcome increased cross-talk levels and reduced EMC properties at data rates up to 1 Gbit/s. The shielding members typically entirely surround the connector housing, thereby providing good shielding performance. However, such shielding members cause additional manufacturing costs.

Known shielding members are typically electrically connected to a separate shielding member of the male connector and/or a further separate shielding member of the female connector to further improve the shielding performance. Thus, a continuous shielding can be achieved over the entire connector length. The contact interface between the separate shielding members is typically achieved using so called contact points. In the art, a contact point is known to have any suitable shape. The shape of a contact point is not reduced to a mathematical point, but can have any suitable shape or area. For example, a contact point can provide a line contact or a surface contact. Contact interfaces, and in particular contact points that are provide a reduced conductivity, conferred to a continuous piece of shielding. Thus, there is a need to reduce the number of contact points.

Further, these contact points are typically provided on so-called contact beams that protrude from a connector and/or a shielding member. Known contact beams are prone to be damaged during storage, transport, and/or mating. This is undesirable because vehicle connectors are typically automatically mated. Thus, a damaged connector can lead to undesirable repair work on an assembly line and/or may require a manual exchange of the damaged connector.

Further, known shielding members may be crimped to a cable and inserted subsequently together with the cable in a connector housing. There is a risk of displacing the shielding member in relation to the connector housing if the cable rotates axially, e.g. when installing a wiring harness within a vehicle. Mating forces may increase if a rotational displacement occurs and mating may become impossible and/or the connector may be damaged during mating.

Therefore, there is a previously unmet need to provide an electrical shielding member for a network connector, a network connector and a network connector system that overcome the aforementioned drawbacks.

An electrical shielding member for a network connector is presented herein. The electrical shielding member is made from cut and bent sheet metal, such as that produced by a stamping process. The electrical shielding member comprises a receiving portion for receiving a cable end of a shielded cable. The receiving portion is configured to be in contact with the shielding of the cable. Further, the electrical shielding member comprises a contact beam extending from the receiving portion. The contact beam comprises a first contact point for electrically connecting the electrical shielding member to a counter shielding member of a counter network connector. Further, the contact beam comprises a coupling portion provided at a distal end of the contact beam. The coupling portion is configured to be coupled to a corresponding coupling portion of a network connector housing. The contact beam is a flexible contact beam that is arranged outwardly inclined with respect to the receiving portion when the electrical shielding member in a non-assembled condition. The distal end of the contact beam is configured to be inwardly deflected when the coupling portion of the contact beam is coupled to the corresponding coupling portion of the network connector housing.

The electrical shielding member enables a network connector to communicate at data rates of at least 100 Mbit/s and preferably of at least 1 GBit/s. Forming the electrical shielding member from sheet metal allows high shielding performance to be provided at reduced costs. Further, such shielding members can easily be crimped on or wrapped around a cable end to provide a reliable mechanical and electrical connection between the shielding of the cable and the electrical shielding member.

The receiving portion may entirely enclose the cable end if the cable end is received within the receiving portion. Particularly, the receiving portion may be wrapped around the cable end at least 3000, preferably at least 3300 and most preferably 360° around the cable end to provide a fully shielded cable end. The receiving portion may be at least partially wrapped around the cable end and can be crimped thereto. Further, the receiving portion can alternatively or additionally comprise a solder portion and/or a welding portion to solder or weld the receiving portion with the shielding of the cable.

The shielding of the cable can be provided in form of a stranded shielding, a braided shielding, a foil shielding, or any other type of shielding.

The contact beam that extends from the receiving portion allows electrical connection of the shielding member with a counter shielding member of a counter network connector. Thus, the number of separate shielding members can be reduced from three to two, since no separate shielding member is required in the connector housing. Thus, the number of serial contact interfaces can be reduced, thereby resulting in a reduction of the resistance of the overall shielding. Thus, the shielding performance can be improved.

The coupling portion of the contact beam allows the distal end of the contact beam to couple with the connector housing. Therefore, the contact beam is additionally secured at the distal end and a pre-load force is applied. The pre-load force, measured at the coupling portion of the contact beam, may be in the range of 0.1 to 0.5 N, preferably in the range of 0.2 to 0.4 N and most preferably in the range of 0.25 to 0.3 N. As the contact beam extends on its proximal end from the receiving portion, the contact beam is fixed at two ends, in the assembled condition of the shielding member. Thus, the contact beam can be preloaded with a defined spring force, resulting in a reduced mating force. Further, the mating force can be controlled and kept almost constant during the mating procedure which facilitates the automated assembly of a network connector comprising the electrical shielding member. Still further, by coupling the coupling portion of the contact beam to the connector housing, the contact beam is less prone to damage such as kinking or rotational displacement of the contact beams and/or the shielding member with respect to the housing.

Further, the receiving portion may be a receiving ferrule. The contact beam may extend substantial parallel to a longitudinal axis of the receiving ferrule if the coupling portion of the contact beam is coupled to a corresponding coupling portion of a network connector housing. Providing a receiving ferrule allows for a safe electrical and mechanical connection between the electrical shielding member and the cable end. Further, arranging the contact beam(s) substantial parallel to the ferule allows for reduced contact and mating forces. The ferrule shape of the receiving portion further allows for a fully (i.e. preferably 360°) shielding of the cable end.

The coupling portion of the contact beam may be a coupling protrusion and may have a width that is less than a width of the distal end of the coupling beam. The coupling protrusion may extend from the distal end of the contact beam and therefore allows the contact beam to be secured at its distal end when the electrical shielding member is in an assembled state. Providing a coupling protrusion with a reduced width compared to the distal end of the contact beam allows for a facilitated coupling with the corresponding coupling portion. Particularly, the coupling protrusion may define a maximum insertion depth of the coupling protrusion into a corresponding coupling portion of the counter of the connector housing. Thus, also the insertion depth of the shielding member into a connector housing is limited. Therefore, the assembly of the electrical shielding member in a network connector/network connector housing is facilitated.

Further, the contact beam may comprise a second contact point. Further the contact beam may comprise a third contact point. The second and/or third contact point(s) are configured to electrically connecting the electrical shielding member to a counter shielding member of a counter network connector. The second and/or third contact points may be provided on the contact beam between the first contact point and the receiving portion of the electrical shielding member.

Increasing the number of contact points that are provided in a parallel circuit reduces the overall contact resistance and is therefore desirable as it leads to higher shielding performance. Further, the shielding is less prone to damage because if one contact point does not correctly contact with a counter shielding member, there are other contact points that can provide a sufficient electrical connection. Thus, the electrical shielding member is less prone to damage and/or contamination, caused e.g. by oil, dust or the like. Still further, providing multiple contact points in parallel allows for a vibration resistant connection, since a contact point can provide a proper electrical connection even if vibration occurs. Vibration may be caused to due uneven road surface or vibrations that are internally generated within a vehicle, e.g. due to engine vibration.

Further, each contact point may be arranged on the contact beam to have its own sliding trace. Particularly, at least two contact points may be provided on the contact beam that have different sliding traces. A sliding trace is the trace that is followed by the contact point during mating. Providing different sliding traces allows for a reliable electrical connection and thus for improved shielding.

The longitudinal distance between the first and the second and/or the first and the third contact points of a contact beam may be at least 3 mm, preferably at least 4 mm and most preferably at least 4.5 mm. In particular, the longitudinal distance between the first and the second and/or the first and the third contact points may be in the range of 4 to 5 mm. The longitudinal distance lead to a flexible contact beam with spaced apart contact points, that can stay in contact with a corresponding shielding member, e.g. during mating or under harsh conditions, such vibration or impact.

The contact beam may further comprise a first section, extending from the receiving portion. The first section is arranged outwardly inclined with respect to the receiving portion, a second section that extends from the first section and is arranged substantially parallel to a mating direction of a network connector, and a third section that extends from the second section. The third section is arranged inwardly inclined with respect to the second section, in an assembled state of the electrical shielding member. The first contact point may be provided between the second and the third section. The second and/or third contact point may be provided between the first and the second section.

This structure of the contact beam allows to provide multiple contact points longitudinally distributed along the contact beam, in a parallel circuit fashion. Thus, the interface resistance of the electrical shielding member can be reduced when being connected to a corresponding counter shielding member. Further, it has shown that this structure of the contact beam leads to a reduced mating or insertion force and is less prone to damages, such as kinking.

The contact beam may comprise a longitudinal cut-out portion. The longitudinal cut-out portion may be provided in the first and/or second section of the contact beam. Providing the longitudinal cut-out portion allows to increase the flexibility of the contact beam. Thereby, the contact force can be configured and the mating or insertion force can be reduced. Particularly, the longitudinal cut-out portion may be provided so that the first contact point and the third contact point are arranged on opposing sides of the cut-out portion but on the same face of the contact beam.

The mating or insertion force may be in the range of 1 to 5 N, preferably in the range of 1.5 to 3.5 N and most preferably in the range of 2 to 3 N.

The electrical shielding member may comprise at least two contact beams, preferably at least three contact beams, and most preferably at least four contact beams. The contact beams may be equally distributed around a circumference of the receiving portion in an assembled state. Increasing the number of contact beams leads to a reduced resistance of the mating interface and to improved shielding properties. For example, a connector that communicates at 200 MHz and that is provided with the above electrical shielding member can achieve a damping of at least 60 dB, preferably of at least 65 dB and most preferably of at least 70 dB.

Further, the length of the contact beam may be in the range of 6 to 14 mm, preferably in the range 7 to 12 mm, and most preferably in the range from 8 to 10 mm. Providing a contact beam having this length may lead to an improved electrostatic discharge (ESD) functionality. Particularly, the contact beam of an electrical shielding member—in the assembled state—may contact a corresponding counter shielding member before the electrical signal terminals of the connector/counter connector come into contact during mating. Thus, the grounded electrical shielding member can improve ESD functionality.

Further, width of a contact beam can be in the range from 1.5 to 3 mm, preferably in the range of 1.8 to 2.8 mm, and most preferably in the range of 1.9 to 2.3 mm. These dimensions have shown to provide improved shielding and reduced mating or insertion force. A wide contact beam provides improved shielding properties when contrasted with contact beams having a smaller width. By providing a longitudinal cut-out portion, the desired level flexibility of a wider contact beam can be maintained. The cut-out portion may have a width in the range of range from 0.2 to 1.3 mm, preferably in the range of 0.3 to 1 mm and most preferably in the range of 0.4 to 0.6 mm.

The contact beam and the receiving portion may be integrally formed. Thus, there are no contact interfaces between the receiving portion and the contact beam(s) and therefore, the resistivity of the electrical shielding member can be reduced leading to improved shielding properties.

The problems are further solved by a network connector. The network connector may be capable of communicating at data rates of at least 100 Mbit/s and/or at least 1 GBit/s. The network connector comprises a contact terminal, a network connector housing and the above described electrical shielding member. The electrical shielding member is at least partially received within the network connector housing. These network connectors allow for a reliable communication at high data rates.

The network connector housing comprises a corresponding coupling portion that is configured to couple with the coupling portion of the contact beam of the electrical shielding member. With coupling the contact beam of the shielding member with the corresponding coupling portion of the connector housing, the contact beam is fixed at a distal end and at a proximal end. This allows for reduced mating or insertion forces, and to provide a more reliable network connector that is less prone to damages such as nicking the contact beams or a rotational displacement of the electrical shielding member with respect to the connector housing.

The corresponding coupling portion may be a coupling recess or stirrup-like shaped coupling portion. The corresponding coupling portion may be configured to enclose the coupling portion of the contact beam on at least four sides. Thus, the coupling portion of the distal end of the contact beam is securely held in the corresponding coupling portion and the electrical shielding member can be secured against e.g. a rotational displacement.

The above described problems are further solved by a network connector system comprising the above described network connector and a corresponding counter connector. The corresponding counter connector is provided with a counter shielding member that is configured to be electrically connected to the contact point of the contact beam of the network connector and wherein the network connector system is an Ethernet network connector system that is configured to transmit data with a data rate of at least 100 Mbit/s and preferably with at least 1 Gbit/s. The network connector system allows for a reliable and secure communication for example in a vehicle.

Further, the above problems are solved with a method to assemble a network connector as described above. Wherein the method comprises the steps of providing a connector housing, providing an electrical shielding member as described above and deflecting the contact beams of the electrical shielding member inwardly and coupling the coupling portion of the contact beam with the corresponding coupling portion of the network connector housing. Therewith, a preloaded contact beam is provided that allows for reduced mating or insertion force and an additional fixation of the electrical shielding member within the housing, so that the shielding member is less prone to a rotational displacement.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

In particular, FIG. 1 shows an electrical shielding member 100, having a receiving portion 110 and two contact beams 120, 140 for electrically connecting the electrical shielding member 100 to a counter shielding member 600 of a counter network connector. The contact beams extend from the receiving portion 110. The contact beams 120,140 are flexible contact beams that are arranged outwardly inclined with respect to the receiving portion 110.

A first section 121, 141 of the contact beam 120, 140 extends from the receiving portion and is arranged outwardly inclined with respect to the receiving portion 110. A second section 122, 142 extends from the first section 121, 141 and is arranged substantially parallel to the mating direction A of the network connector, if the electrical shielding member is in an assembled condition, i.e. installed within the housing of an electrical network connector. Further, a third section 123, 143 is provided and extends from the second section 122, 142. A third section 123, 143 is arranged inwardly inclined with respect to the second section 122, 142. The third section 123, 143 further provides a distal end. A coupling portion 125, 145 of the contact beam 120, 140 extends from the distal end.

The first contact point 127, 147 is provided at the intersection between the second section 122, 142 and third section 123, 143. At the intersection between the first section 121, 141 and the second section 122, 142, second and third contact points 128, 129; 148, 149 are provided. The first and second contact points 127 to 129 and 147 to 149 are provided as line contacts. Other contact geometries are also possible.

Still further, a cut-out portion 124, 144 is provided in each contact beam. The cut-out portion extends, at least partially along the first and/or second section of the contact beam 120, 140. The third and second contact points 128, 129; 148, 149 are provided on opposing sides of the cut-out portion 124; 144. The cut-out portion allows for reduced mating or insertion forces. Due to the longitudinally extending contact beams 120, 140 and the longitudinal cut out portion 124, 144 a highly flexible contact beam 120, 140 is provided that provides reduced mating or insertion force and a desired contact force.

Further, with providing multiple contact points in a parallel circuit-fashion, a reduced interface resistance and therefore improved shielding properties can be achieved. The electrical shielding member 100 of FIG. 1 comprises six contact points, wherein each contact beam carries three contact points. The coupling portions 125, 145 are configured to couple with corresponding coupling portions 225, 245 of a network connector housing, as shown in FIG. 2.

Figure 2:
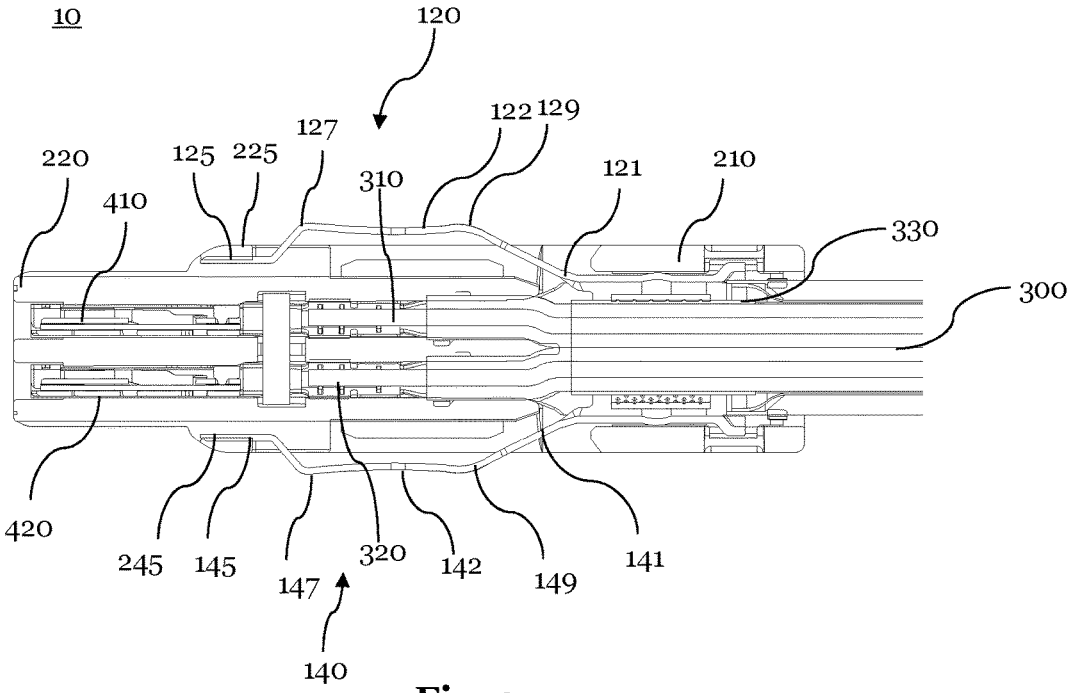
FIG. 2 is a cross section view of a network connector with the shielding member of FIG. 1 assembled therein according to an embodiment of the invention.

FIG. 2 shows a cross section view of an electrical network connector, hereinafter referred to as the connector 10, comprising two contact terminals 410, 420 and an electrical shielding member 100, as shown in FIG. 1. The contact terminals 410, 420 and the electrical shielding member 100 are housed in the network connector housing, hereinafter referred to as the housing 200, which is a two-part housing, comprising at least first at second housing parts 210, 220. The second housing part 220 is provided with corresponding coupling portions 225, 245 at couple to the coupling portions 125, 145 of the contact beams 120, 140, when the electrical shielding member 100 is in the assembled state, as shown. The contact beams 120, 140 extend from the receiving portion 110 and are fixed to the housing at the coupling portion 125, 145, i.e. at the distal ends of the contact beams. The contact beam 120, 140 is fixed at two ends and is therefore less prone to damages or rotational displacement.

The receiving portion 110 receives a cable 300 and is electrically connected to the shielding 330 of the cable 300. The cable 300 may be a twisted pair cable, such as a unshielded twisted pair (UTP), shielded twisted pair (STP) or foil screened twisted pair (FTP) cable.

Figure 3:
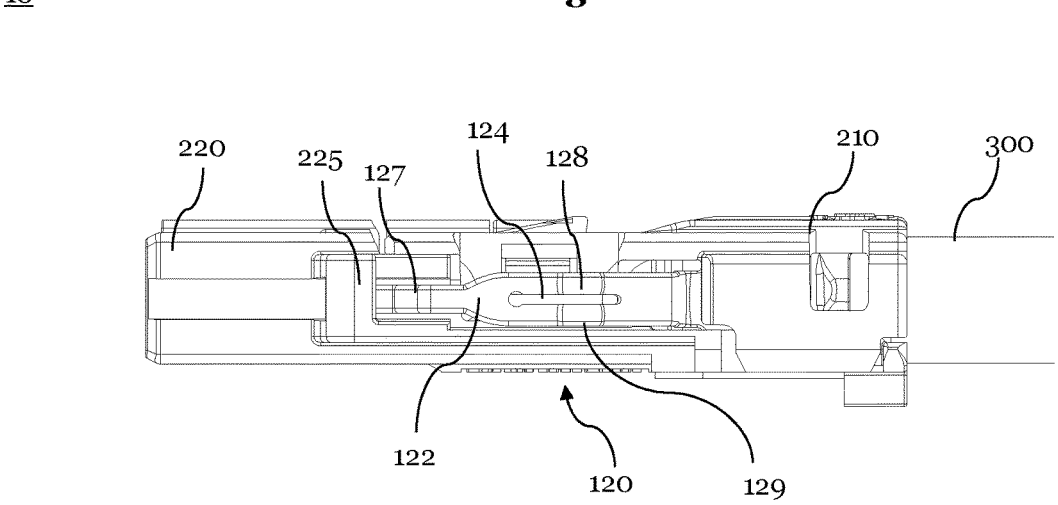
FIG. 3 is a side view of a network connector according to an embodiment of the invention.

FIG. 3 shows the connector 10 in an assembled state. As shown, the contact terminals 410, 420 are completely housed by housing 200, comprising first and second housing parts 210, 220. The contact beams 120 of the electrical shielding member 100 extend outwardly from the housing 200 and are secured at the distal end by the coupling portion 125 and the corresponding coupling portion 225. The corresponding coupling portion 225 can be formed as a coupling recess that receives a coupling portion that is formed as coupling portion 125 of the contact beam 120. The coupling portion 125 may be enclosed on at least four sides by the coupling portion 225 of the housing 200. Thereby the electrical shielding member 100 is secured against rotational displacement.

Figure 4A:
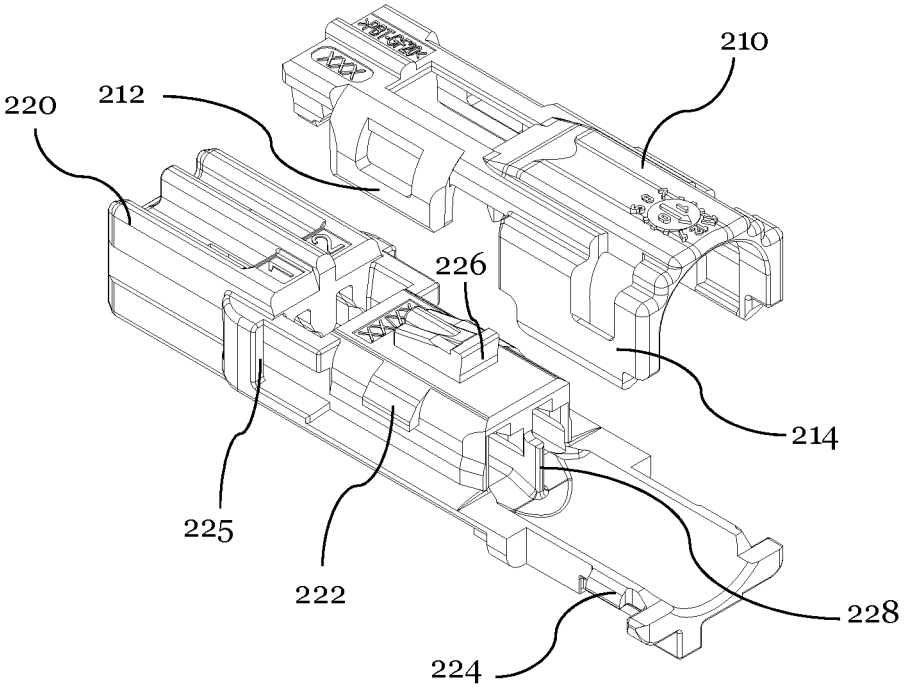
FIG. 4A is a perspective exploded view of a network connector housing according to an embodiment of the invention.
Figure 4B:
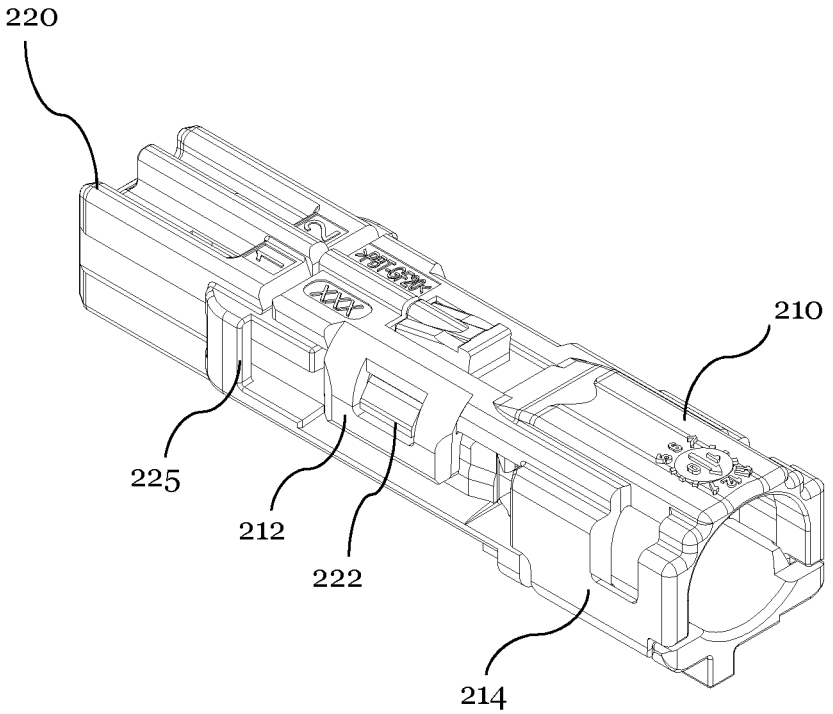
FIG. 4B is a perspective view of a network connector housing of FIG. 4A in an assembled condition according to an embodiment of the invention.

FIG. 4A shows an exploded view of the housing 200, having a first housing part 210 and a second housing part 220. The second housing part 220 is provided with corresponding coupling portions 225, 245 for receiving the coupling portions of the contact beams 120, 140. Further, the second housing part 220 is provided with first and second locking elements 222, 224. The first housing part 210 is provided with corresponding locking elements 212, 214. The first and second locking elements 222, 224 and the corresponding first and second locking elements 212, 214 latch with each other, when the housing 200 is assembled. First and second locking elements 222, 224 and the corresponding first and second locking elements 212, 214 prevent the first housing part 210 from being separated from the second housing part 220.

Further, the housing 200 and in particular the second housing part 220 can be provided with a stopping member 228. The stopping member 228 may be arranged in a middle portion of the housing part 220 and may be sandwiched between a first and second electrical contact terminal receiving channel. Each of the first and second electrical contact terminal receiving channel is configured to receive the first and second contact terminals 410, 420, respectively, in an assembled state of the connector 10. The stopping member 228 is configured to abut with an intersecting point of the cable. The intersecting point of the cable, is the point where the first and second wire leave the cable insulation sleeve. Thus, the stopping member 228 allows to limit the insertion depth of the cable 300 and/or the electrical shielding member 100 into the housing 200. In particular, the stopping member 228 can be arranged so that it abuts with the intersecting point of the cable before the coupling portion 125, 145 of the contact beam 120, 140 abuts with an end face of the corresponding coupling portion 125, 145. Thus, damaging the contact beams 120, 140 during assembly can be prevented.

Figure 5A:
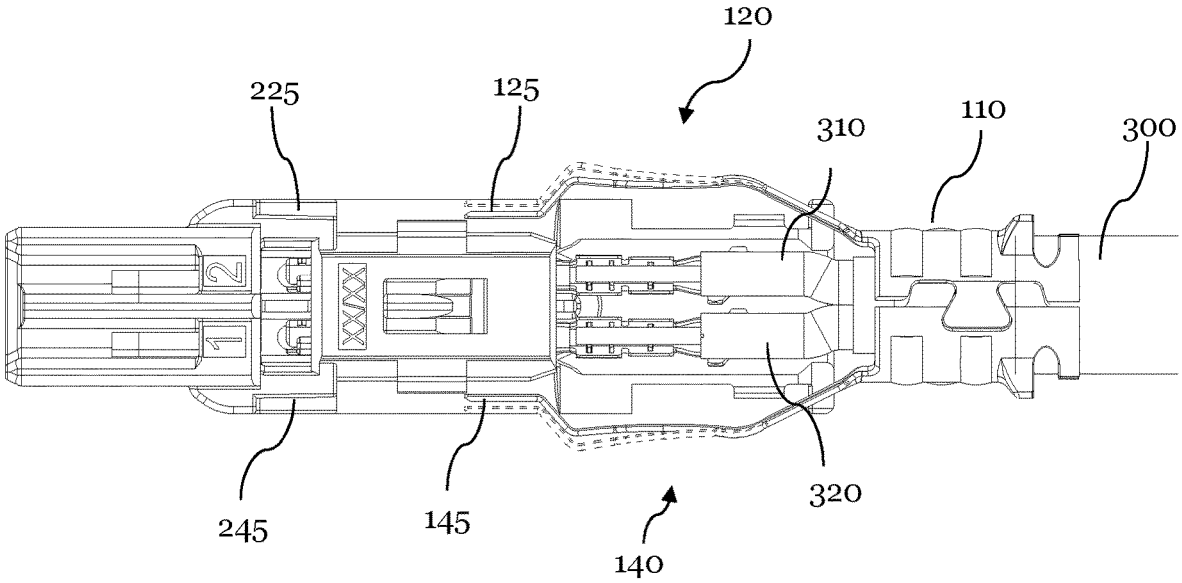
FIG. 5A is a top view of an assembly of an electric shielding member according to an embodiment of the invention.
Figure 5B:
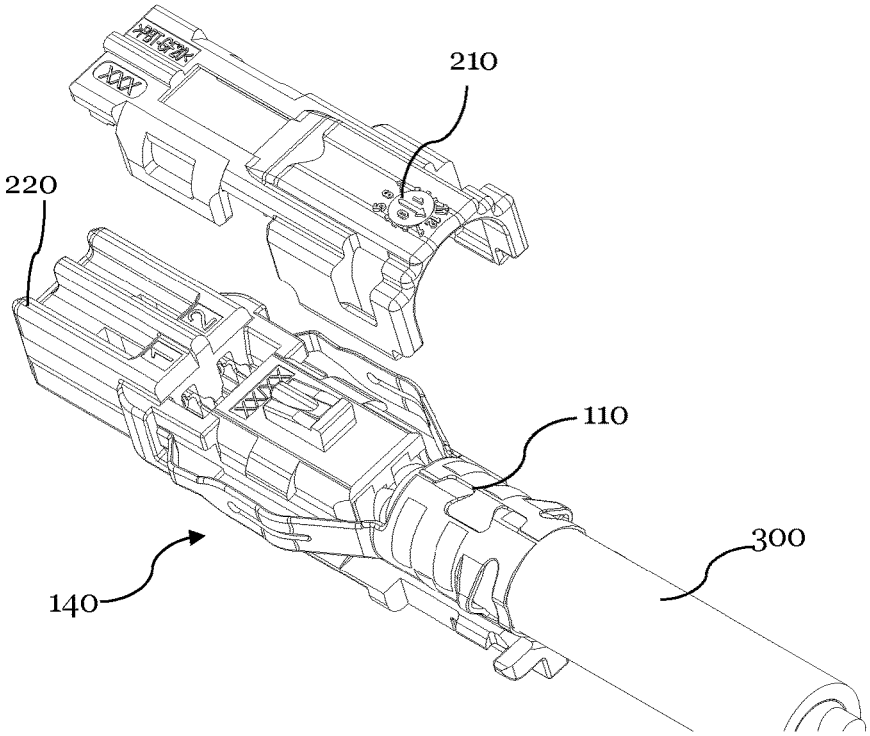
FIG. 5B is an exploded perspective view of an electrical connector housing according to an embodiment of the invention.
Figure 5C:
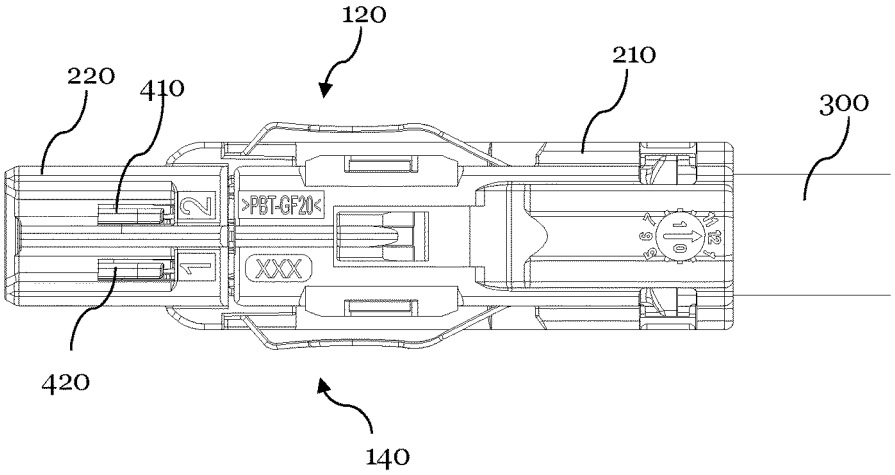
FIG. 5C is a top view of a network connector in an assembled condition according to an embodiment of the invention.

FIGS. 5A to 5C illustrate an assembly sequence of the connector 10. The electrical shielding member 100 is wrapped around the cable 300. In FIG. 5A, the electrical shielding member 100 is crimped to electrically contact the shielding 330 of the cable 300. In alternative embodiments, the electrical shielding member 100 may be alternatively or additionally soldered or welded to the shielding 330 of the cable 300. The contact beams 120, 140 extend from the receiving portion 110 of electrical shielding member 100 and are arranged outwardly inclined with respect to the receiving portion. For installing the electrical shielding member 100 within the housing 200, the contact beams 120, 140 are deflected inwardly and the coupling portions 125, 145 of the contact beams 120, 140 are inserted into the corresponding coupling portions 225, 245 of the housing 200. The corresponding coupling portions 225, 245 are formed as coupling recesses.

After assembling the electrical shielding member 100 and the cable 300, the first housing part 210 can be latched to the second housing part 220, as shown in FIG. 5B. FIG. 5C shows a top plan view of the assembled connector 10.

Figure 6:
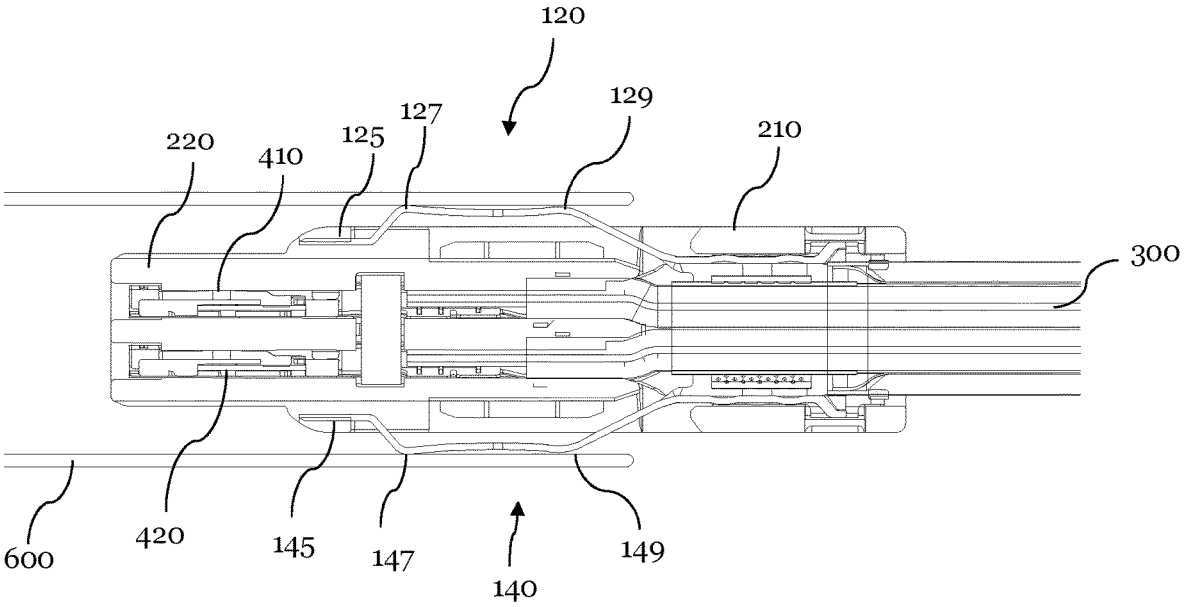
FIG. 6 a cross section view of a network connector system according to an embodiment of the invention.

FIG. 6 shows a cross section view of a network connector system comprising the connector 10 as described with respect to the preceding FIGS. 5A to 5C and a corresponding counter connector, having a corresponding counter shielding member 600. As shown, the first and second and third contact points 127, 128, 129; 147, 148, 149 of the contact beams 120, 140 are in contact with the counter shielding member 600 and provide a continuous shielding for the connector system.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical shielding member cut and bent from sheet metal, the electrical shielding member comprising:

a receiving portion for receiving a cable end of a shielded cable, wherein the receiving portion is configured to be in contact with a shielding of the shielded cable; and a contact beam extending from the receiving portion, wherein the contact beam, comprises:

a first contact point for electrically connecting the electrical shielding member to a counter shielding member of a counter network connector, and a coupling portion provided at a distal end of the contact beam, wherein the coupling portion is configured to be coupled to a corresponding coupling portion of a network connector housing, and wherein the contact beam is a flexible contact beam that is arranged outwardly inclined with respect to the receiving portion when the electrical shielding member in a non-assembled condition wherein at least the distal end of the contact beam is configured to be inwardly deflected and extend parallel to a longitudinal axis of the receiving ferrule when the coupling portion of the contact beam is coupled to the corresponding coupling portion of the network connector housing.

2. The electrical shielding member of claim 1, wherein the receiving portion is a receiving ferrule.

3. The electrical shielding member of claim 1, wherein the coupling portion is a protrusion having a width that is less than a width of the distal end of the contact beam.

4. The electrical shielding member of claim 1, wherein the contact beam comprises a second contact point, wherein the second contact point is provided between the receiving portion and the first contact point, and wherein the second contact point is arranged on the contact beam to have its own sliding trace.

5. An electrical shielding member for a network connector, wherein the electrical shielding member is made from cut and bent sheet metal, the electrical shielding member comprising:

a receiving portion for receiving a cable end of a shielded cable, wherein the receiving portion is configured to be in contact with a shielding of the shielded cable; and a contact beam extending from the receiving portion, wherein the contact beam comprises:

a first contact point for electrically connecting the electrical shielding member to a counter shielding member of a counter network connector, a coupling portion provided at a distal end of the contact beam, wherein the coupling portion is configured to be coupled to a corresponding coupling portion of a network connector housing, and wherein the contact beam is a flexible contact beam that is arranged outwardly inclined with respect to the receiving portion when the electrical shielding member in a non-assembled condition and wherein at least the distal end of the contact beam is configured to be inwardly deflected when the coupling portion of the contact beam is coupled to the corresponding coupling portion of the network connector housing, a second contact point, wherein the second contact point is provided between the receiving portion and the first contact point, and wherein the second contact point is arranged on the contact beam to have its own sliding trace, and a third contact point, wherein the third contact point is provided between the receiving portion and the first contact point, and wherein the third contact point is arranged on the contact beam to have its own sliding trace.

6. The electrical shielding member of claim 5, wherein a longitudinal distance between the first contact point and the second contact point and the third contact point of the contact beam is at least 3 mm.

7. The electrical shielding member of claim 5, wherein the contact beam comprises a longitudinal cut-out portion, wherein the longitudinal cut-out portion extends in the first and/or second section, and wherein the second contact point and the third contact point are provided on opposing sides of the longitudinal cut-out portion and on the same face of the contact beam.

8. An electrical shielding member for a network connector, wherein the electrical shielding member is made from cut and bent sheet metal, the electrical shielding member comprising:

a receiving portion for receiving a cable end of a shielded cable, wherein the receiving portion is configured to be in contact with a shielding of the shielded cable; and a contact beam extending from the receiving portion, wherein the contact beam comprises:

a first contact point for electrically connecting the electrical shielding member to a counter shielding member of a counter network connector, a coupling portion provided at a distal end of the contact beam, wherein the coupling portion is configured to be coupled to a corresponding coupling portion of a network connector housing, and wherein the contact beam is a flexible contact beam that is arranged outwardly inclined with respect to the receiving portion when the electrical shielding member in a non-assembled condition and wherein at least the distal end of the contact beam is configured to be inwardly deflected when the coupling portion of the contact beam is coupled to the corresponding coupling portion of the network connector housing;

a first section extending from the receiving portion, wherein the first section is arranged outwardly inclined with respect to the receiving portion;

a second section that extends from the first section and is arranged substantially parallel to a mating direction of the network connector, and a third section that extends from the second section, wherein the third section is arranged inwardly inclined with respect to the second section in an assembled state of the electrical shielding member wherein the first contact point is provided between the second and the third section, and wherein the second and/or third contact point is provided between the first and the second section.

9. The electrical shielding member of claim 1, wherein the electrical shielding member comprises two contact beams.

10. The electrical shielding member of claim 1, wherein a length of the contact beam is in a range of 6 to 14 mm.

11. The electrical shielding member of claim 1, wherein a width of the contact beam is in a range of 1.5 to 3 mm.

12. The electrical shielding member of claim 1, wherein the contact beam and the receiving portion are integrally formed.

13. A network connector capable of communicating at data rates of at least 100 Mbit/s, comprising:

an electrical contact terminal;

a network connector housing; and the electrical shielding member according claim 1, wherein the electrical shielding member is partially received within the network connector housing.

14. The network connector according to claim 13, wherein the network connector housing comprises the corresponding coupling portion and wherein the corresponding coupling portion is configured to couple with the coupling portion of the contact beam of the electrical shielding member.

15. The network connector according to claim 14, wherein the corresponding coupling portion is a coupling recess and wherein the corresponding coupling portion is configured to enclose the coupling portion of the contact beam on four sides.

16. A network connector system, comprising:

a network connector capable of communicating at data rates of at least 100 Mbit/s, comprising:

an electrical contact terminal;

a network connector housing;

an electrical shielding member made from cut and bent sheet metal, the electrical shielding member comprising:

a receiving portion for receiving a cable end of a shielded cable, wherein the receiving portion is configured to be in contact with a shielding of the shielded cable; and a contact beam extending from the receiving portion, wherein the contact beam comprises:

a first contact point for electrically connecting the electrical shielding member to a counter shielding member of a counter network connector, and a coupling portion provided at a distal end of the contact beam, wherein the coupling portion is configured to be coupled to a corresponding coupling portion of a network connector housing, and wherein the contact beam is a flexible contact beam that is arranged outwardly inclined with respect to the receiving portion when the electrical shielding member in a non-assembled condition and wherein at least the distal end of the contact beam is configured to be inwardly deflected when the coupling portion of the contact beam is coupled to the corresponding coupling portion of the network connector housing, wherein the electrical shielding member is at least partially received within the network connector housing; and a corresponding counter connector, wherein the corresponding counter connector is provided with the counter shielding member that is configured to be electrically connected to a contact point of the contact beam of the network connector, wherein the counter shielding member and the contact beam of the network connector are arranged so that they come in contact before the electrical contact terminal of the network connector comes into electrical contact with any part of the corresponding counter connector during mating and wherein the network connector system is an Ethernet-network connector system configured to transmit data with a data rate of at least 100 Mbit/s.

* * * * *